US007493949B2

(12) United States Patent
Baird

(10) Patent No.: US 7,493,949 B2
(45) Date of Patent: Feb. 24, 2009

(54) FLOW THROUGH SUBASSEMBLY FOR A DOWNHOLE DRILL STRING AND METHOD FOR MAKING SAME

(75) Inventor: Jeffery D. Baird, Breckenridge, TX (US)

(73) Assignee: Collapsing Stabilizer Tool, Ltd., Breckenridge, TX (US)

( * ) Notice: Subject to any disclaimer, the term of this patent is extended or adjusted under 35 U.S.C. 154(b) by 140 days.

(21) Appl. No.: 11/122,701

(22) Filed: May 5, 2005

(65) Prior Publication Data

US 2005/0257934 A1 Nov. 24, 2005

Related U.S. Application Data

(63) Continuation-in-part of application No. 10/521,346, filed as application No. PCT/US03/21537 on Jul. 10, 2003, now Pat. No. 7,299,885.

(51) Int. Cl.
*E21B 17/18* (2006.01)
*E21B 17/22* (2006.01)

(52) U.S. Cl. ..... 166/242.1; 166/173; 175/323

(58) Field of Classification Search ..... 175/211, 175/215, 323, 325.2, 339, 381, 406; 166/380, 166/241.6, 242.1, 173
See application file for complete search history.

(56) References Cited

U.S. PATENT DOCUMENTS 2,100,419 A * 11/1937 Wright ..... 175/325.2
RE24,766 E * 1/1960 Scivally ..... 166/173
3,712,392 A * 1/1973 Gorgendiere ..... 175/325.2
3,945,446 A * 3/1976 Ostertag et al. ..... 175/323
4,378,852 A * 4/1983 Garrett ..... 175/325.4
4,798,246 A * 1/1989 Best ..... 166/311
6,776,247 B1 * 8/2004 Bassal ..... 175/325.4

* cited by examiner

*Primary Examiner*—Jennifer H Gay
*Assistant Examiner*—David Andrews
(74) *Attorney, Agent, or Firm*—Jackson Walker, LLP

(57) ABSTRACT

A subassembly for a downhole drill string has a hollow outer body or barrel with a plurality of blade openings. A plurality of blade sets extends outwardly through the openings. Fluid flow inlets are provided in the lower section of the body below the blade openings and flow outlets are provided in an upper section above the blade openings. An annular spaced apart support mandrel extends through the hollow section of body and supports and retains the blades in the openings. An annular fluid flow passage is provided through the annular space. Drilling fluids outside of the subassembly may flow through the inlet, up the annular fluid flow passage, and out the outlet thereby bypassing any plug or pack-off formed between the subassembly and the well bore. An existing subassembly may be retrofitted to provide a fluid flow bypass channel around the blades. The existing subassembly is provided with inlets below and outlets above the blades. The bypass channel is then formed between the blades.

5 Claims, 5 Drawing Sheets

FLOW THROUGH SUBASSEMBLY FOR A DOWNHOLE DRILL STRING AND METHOD FOR MAKING SAME

This is a continuation-in-part application which claims priority to U.S. patent application Ser. No. 10/521,346, filed Jan. 10, 2005, now U.S. Pat. No. 7,299,885 which claims priority to International Patent Application No. PCT/US2003/21537, filed Jul. 10, 2003.

BACKGROUND OF THE INVENTION

The present invention relates to improved subassemblies for a downhole drill string. More particularly, but not by way of limitation, the present invention relates to stabilizer or reamer subassemblies which allow drilling mud fluid to flow through or around the stabilizer/reamer body. The present invention may be utilized with either vertical or horizontal drilling operations. Further the invention relates to a method for retrofitting existing subassemblies to provide the flow through feature.

A drill string is used to drill a subterranean well bore. The drill string typically consists of multiple joints of drill pipe, drill collars, and a drill bit. To facilitate completion of the well, it is important that deviation from the desired drill path be closely controlled. Additional equipment has been utilized to stabilize the drill string. These devices are commonly known as stabilizers. Sometimes it is necessary to slightly enlarge or clean an existing well bore or casing. These devices are called reamers or scrapers. These tools have a larger outside diameter than the drill collars and are in constant rotational contact with the sidewall of the well bore during the drilling process.

The problem with stabilizers/reamers/scrapers is that the contact between the device and the well bore can create conditions whereby penetrated, soft formations may collapse or swell inwardly after penetration of the bit. This may cause the device to become stuck. Sometimes water loss in some formations may cause excessive mud cake buildup on the wall of the well bore which results in sticking at the device. Formation fracturing may occur from debris packing off at the subassembly and from increased hydraulic pressure from the restricted flow of drilling fluid at the pack-off site. Packing-off may also contribute to interrupted weight on the drill bit.

Sometimes reamers which are cutting a larger bore above the drill bit bore become lodged in the walls of the formation, slowing down or stopping the drilling process. Occasionally, a casing scraper used to clean an in-place casing run also becomes stuck within the casing. These problems are tremendously costly to correct with current technology. Often the drill string must be left in the well bore and the well bore redrilled.

Thus, there is a need to provide a fluid flow through path or bypass around a packed-off or stuck subassembly. The present invention and method provide such a bypass and solves the problems associated with packing-off around the subassembly.

DETAILED DESCRIPTION OF THE PREFERRED EMBODIMENT

Figure 1:
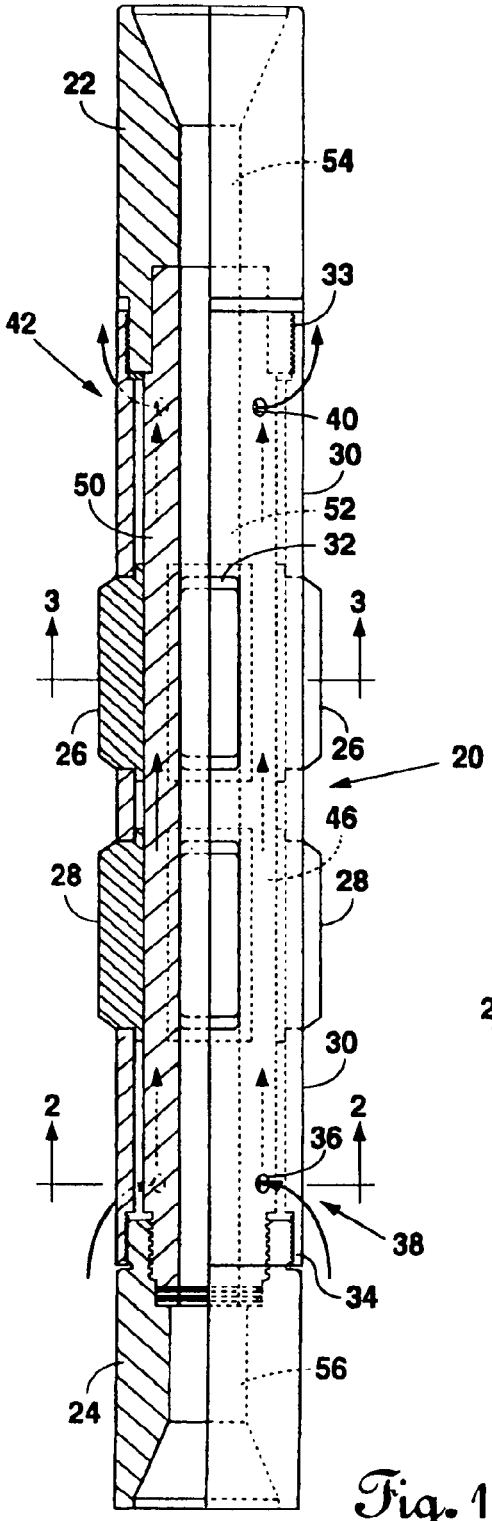
FIG. 1 illustrates an elevation view, in partial cross-section, of a stabilizer subassembly for attachment to a drill string showing one embodiment of a fluid flow bypass of the present invention.

FIG. 1 illustrates a stabilizer subassembly 20 attached to an upper subassembly 22 and a lower subassembly 24 of a drill string. The placement of stabilizer 20 along the string length may vary depending on specific drilling conditions.

While stabilizer 20 is shown in a non-collapsible embodiment wherein the blade sets 26 and 28 are not retractable to a smaller outer diameter, it should be understood that the flow-through/flow-by or bypass feature of the present invention may be incorporated into a retractable configuration. Co-pending U.S. patent application Ser. No. 10/521,346, which is incorporated herein for all purposes, discloses a retractable configuration. Further, this flow control feature may be utilized with other subassemblies such as reamers and scrapers.

Stabilizer 20 has a generally hollow cylindrical outer body member or barrel 30, with openings or windows 32 through which extend blades 26 and 28. The blades are retained in openings 32 by flared shoulders 37 (FIG. 2), which are wider than the openings 32, and by a support mandrel described below. In operation, the blades urge against the well bore wall stabilizing the rotation of the drill string. The body member 30 may be threadingly attached at an upper threaded end 33 and a lower threaded end 34. A hollow tubular mandrel 50 extends longitudinally through the body member 30 and provides a support surface for the blades 26 and 28. The bottom surface of the blades rest against the outer surface of the mandrel 50. Removal of the mandrel allows for the quick and easy changing or replacement of the blades.

The body member is provided with a plurality of flow-through inlet openings 36 along the lower portion 38 of the barrel 30. Openings 36 allow drilling fluids to communicate between the external well bore and the internal sections of the subassembly. The flow arrows show drilling fluid may enter openings 36 and pass through a flow passage 46 inside assembly 20. The passage 46 is formed in the space between the inner wall of the barrel 30 and the outer surface of the mandrel 50. Drilling fluid flows through passage 46 and out openings 40 in the upper section 42 of the body 30. Thus drilling fluids may seek a path of lesser resistance by going through the subassembly 20 rather than by going through the space between the outside of the subassembly 20 and the well bore wall. This internal flow path is particularly less resistive when debris begins to pack around and between the blades of the subassembly and the well bore wall.

Figure 2:
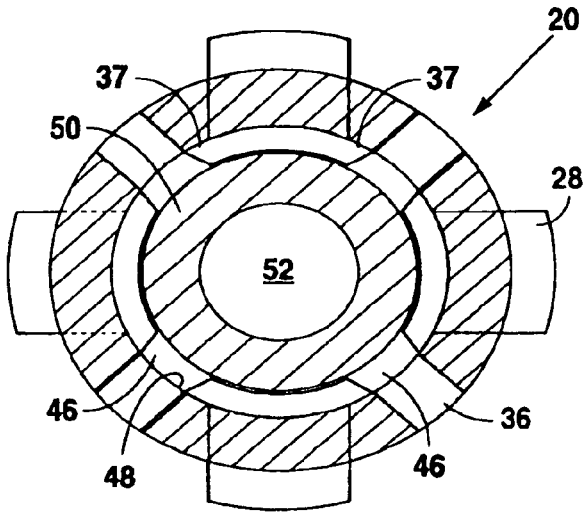
FIG. 2 is a cross-sectional view of the stabilizer subassembly of FIG. 1 taken along line 2-2 of FIG. 1.

FIG. 2 illustrates a cross-sectional view of stabilizer 20 taken along line 2-2 of FIG. 1. The lower surface of blades 28 is supported by the outside surface 44 of support mandrel 50. An annular space or passage 46 is formed between the mandrel 50 and the inner wall 48 of the barrel 30. It is through this passage 46 that the drilling fluids may flow.

Figure 3:
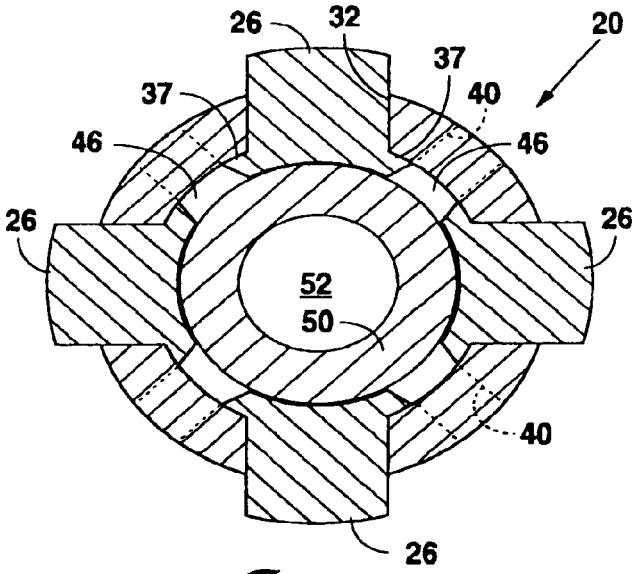
FIG. 3 is a cross-sectional view of the stabilizer subassembly of FIG. 1 taken along line 3-3 of FIG. 1.

FIG. 3 shows a cross-sectional view of stabilizer 20 taken along line 3-3 of FIG. 1. A central bore 52 runs through the subassembly 20 and is aligned and cooperates with the central bores 54 and 56 of the other components of the drill string. The support mandrel 50 supports the blades 26 within the windows 32 of the stabilizer body member 30.

As described above, the bypassing drilling mud flows into the subassembly below the blades, through the passage 46 inside the subassembly 20 and out the discharge openings 40 above the stabilizer blade set 26. Thus, the drilling mud follows this path of least resistance pass any "pack-off," plug or buildup between the blades 26 and 28, the outer surface of the barrel 30, and the walls of the well bore.

Figure 4:
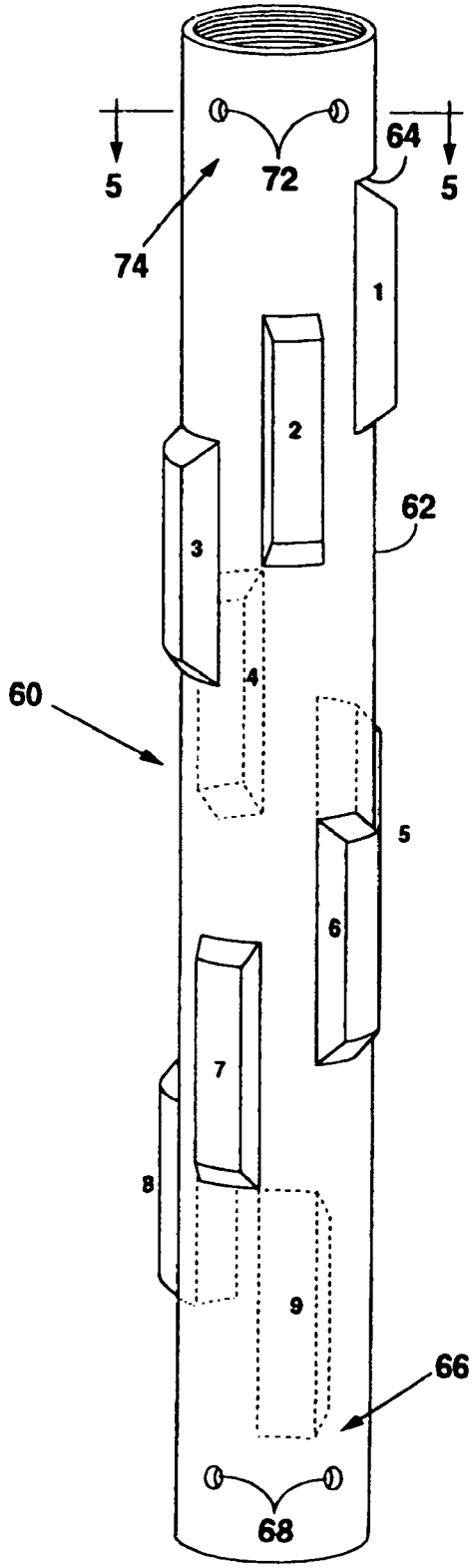
FIG. 4 illustrates an elevation, perspective view of another embodiment of a stabilizer subassembly for attachment to a drill string having a fluid flow bypass and a flow-by blade configuration.
Figure 5:
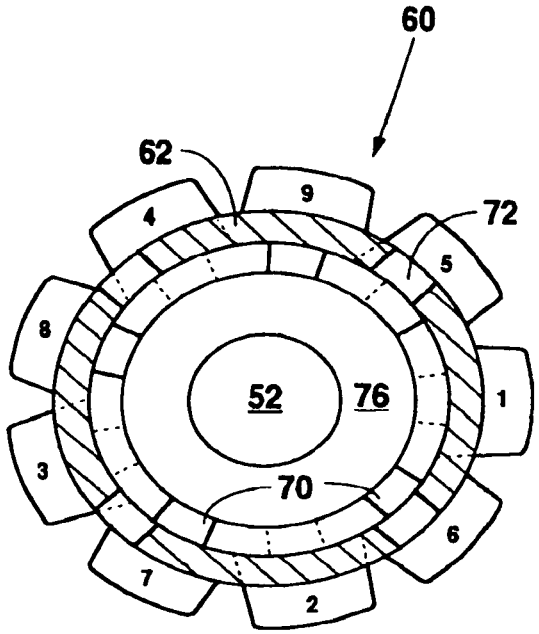
FIG. 5 is a cross-sectional view of the stabilizer subassembly of FIG. 4 taken along line 5-5.

Turning to FIGS. 4 and 5, another embodiment of a stabilizer subassembly 60 is illustrated. In a perspective view (FIG. 4), the subassembly 60 is seen as having a generally cylindrical body or outer barrel member 62 with a plurality of windows 64 which retain a series of helically arranged blades 1 thru 9. Along the lower portion 66 of the body 62 are inlet openings 68 which allow drilling fluids to enter from the well bore outside the barrel or body 62, into the internal flow passage 70 (FIG. 5) within the body, and out the discharge openings 72 in the upper portion 74 of the stabilizer. It should be understood that the blades 1 thru 9 are support by support mandrel 76 (FIG. 5) in the same way as described for stabilizer 20 above. For clarity purposes, FIG. 4 does not show the support mandrel 76.

The unique helical or spiral arrangement of the blades around the body facilitates the flow of drilling fluids outside the subassembly between the walls of the well bore and the subassembly body. There is less likelihood of a plug or pack-off forming in the space between the stabilizer and the well bore wall, because as the drill string rotates, a "screwing" or swirling flow is created in the fluid by the rotation of the blades within the well bore. Despite this improved, unique blade arrangement, it is possible for some buildups to form. This may increase the energy required for the drilling operation. Thus, the combination of the spiral blade placement with the flow-through features operates well in the most difficult circumstances.

When flow is restricted externally of the subassembly, drilling fluids may bypass through the internal flow path 70 in the stabilizer body. FIG. 5 illustrates a cross-sectional view of the stabilizer 60 taken along line 5-5 of FIG. 4.

Figure 6:
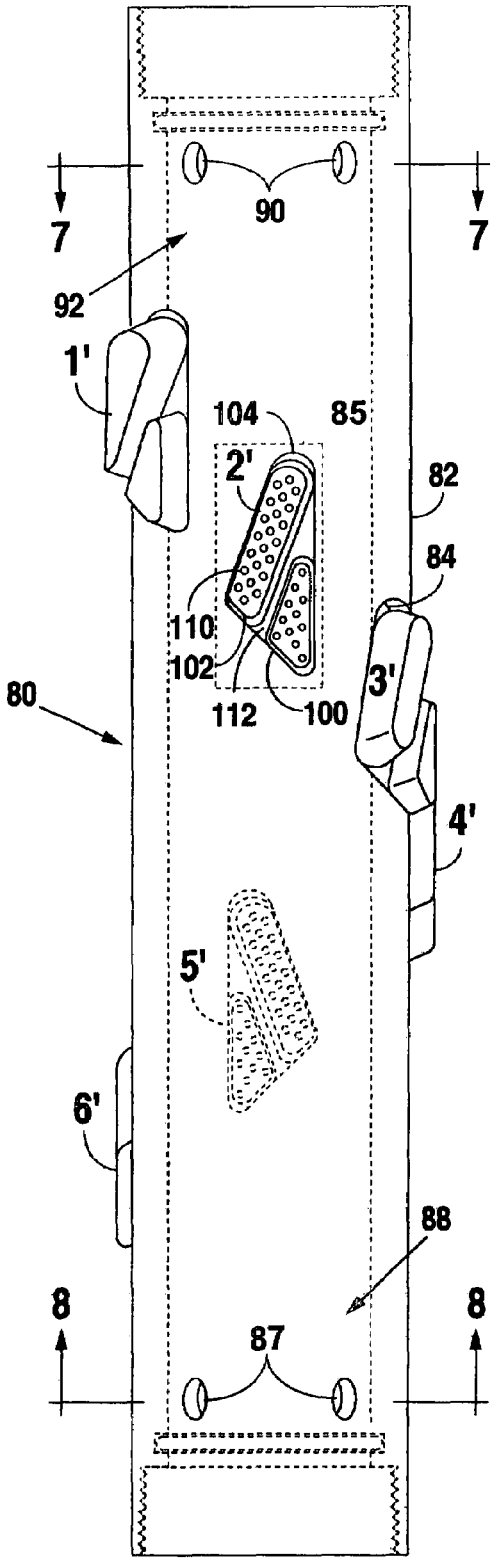
FIG. 6 illustrates an elevation, perspective view of yet another embodiment of a stabilizer subassembly for attachment to a drill string having a fluid flow bypass, a flow-by blade configuration, and a wedge-shape blade construction.

FIG. 6 shows yet another subassembly or stabilizer embodiment 80 which has six wedge-shaped blade sets windows (1' thru 6') in a helical arrangement around the body/barrel 82. Each set of blades is retained in a wedge-shaped window 84 in the body 82. In FIG. 6, the support mandrel 86 (FIGS. 7 and 8) again is not shown for clarity purposes. However, it should be understood that the support mandrel 86 has a central bore 52 (as described above) and that it supports the blade sets within the windows.

As with the previously described embodiments 20 and 60, subassembly 80 has inlet openings 87 along a lower section 88 of the subassembly below the blades and outlet openings 90 around the upper section 92 above the blades. A fluid flow bypass path 94 is provided between the support mandrel outer surface and the inner wall of the assembly body 82 as may be understood from the above embodiments.

Thus subassembly 80 incorporates benefits of the helical swirling of the drilling fluids external of the subassembly and the internal bypass flow path. Further, the unique configuration and structure of the blade sets improves the blade wear life and reduces the likelihood of plug buildups.

As the subassembly 80 rotates in the clockwise direction and travels downwardly by the drilling operations, the blades experience high stress forces along faces 100 and 102. The forces push the blade set upwardly (and to the right as shown) into the wedge taper or corner 104 of the window. Thus any wear in the sides of the blades is compensated for by the tight fit of the blade set into the taper as it moves upwardly. This eliminates any backlashing of the blades.

FIG. 6 also shows that the wear surfaces of the blades may be provided with tungsten carbide particle 110 or other wear resistant materials.

Figure 7:
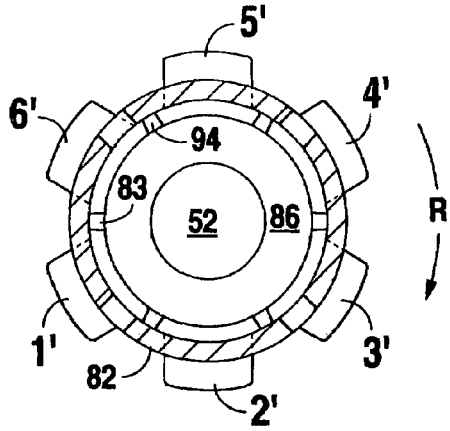
FIG. 7 is a cross-sectional view of the stabilizer subassembly of FIG. 6 taken along line 7-7.
Figure 8:
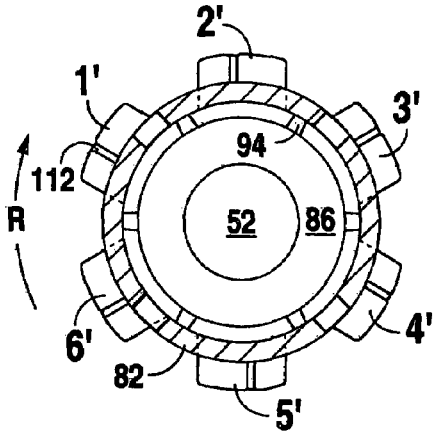
FIG. 8 is a cross-sectional view of the stabilizer subassembly of FIG. 6 taken along line 8-8.

FIGS. 7 and 8 are cross-sectional views taken along lines 7-7 and 8-8 of FIG. 6, respectively. FIG. 7 illustrates the support of the blades by the hollow mandrel 86. The flow passage 94 is formed in the annular space between the inner surface 83 of the barrel 82.

The particular blade sets illustrated in embodiment 80 are provided with a channel 112 between the blade segments. This channel allows for improved fluid flow past the blades during operation.

At the present time, there are thousands of existing standard subassemblies in use in the field. Each of these subassemblies may be modified or retrofitted to provide the present flow through or bypass feature. The possibility of easily modifying an existing subassembly could result in million dollar savings in lost production time and equipment costs.

Figure 9:
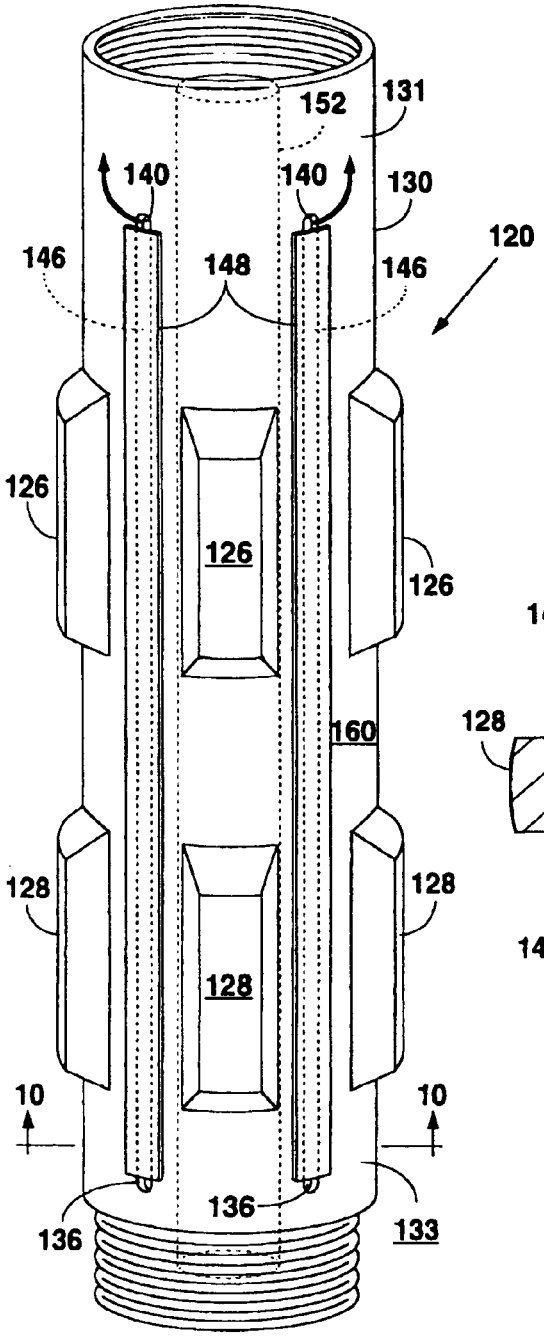
FIG. 9 illustrates an elevation, perspective view of a retrofitted subassembly modified by the method of the present invention.

FIG. 9 illustrates one example of an existing subassembly (in this case a two blade set stabilizer) 120. The subassembly 120 is a generally thick walled barrel 130 with a central fluid passage 152 extending longitudinally from an upper end 131 to a lower end 133 of the barrel. The ends are threaded for connection to the drill string as needed.

A number of outwardly projecting blades are shown as blade sets 126 and 128 which are positioned around the outer circumference of the barrel. The blades may be retractable or non-retractable.

Figure 10:
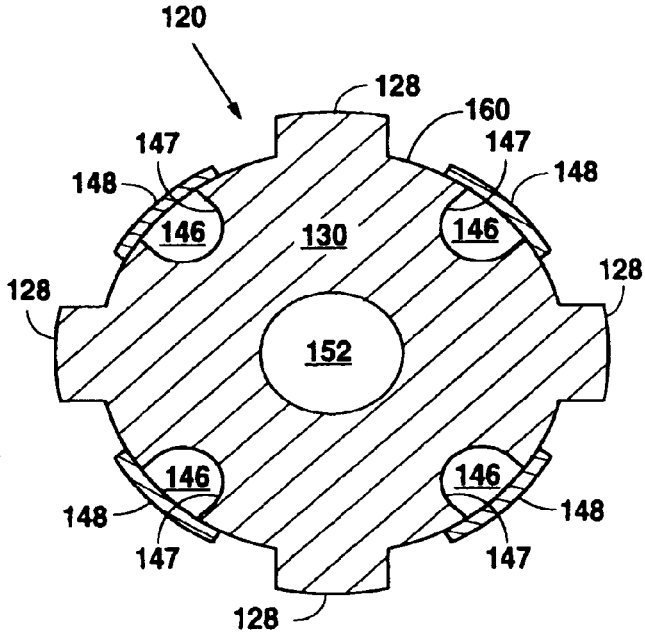
FIG. 10 is a cross-sectional view of the subassembly of FIG. 9 taken along line 10-10 of FIG. 9.

In order to provide a fluid flow through or bypass, a channel must be provided in the body wall. The simplest method is to cut a series of longitudinal grooves 147 into the outer wall surface 160 of the body 130 between the blade sets as shown in FIGS. 9 and 10. The channels should extend from below the lower set of blades to above the upper set of blades. Once the channels 147 are cut, flat plates or cover sheets 148 may be affixed over the channel 147 by any appropriate means, including welding, use of fasteners or adhesives. The plates 148 are shorter in length than the channels 147 and are positioned over the channels 147 to form an inlet opening 136 below the blades and an outlet opening 140 above the blades. Thus, with this simple modification, a bypass flow passage 146 is formed which extends past the blades.

There are many alternative ways to provide a bypass flow passage past the blades, including drilling a hole from the lower section, outside surface of the barrel, into the barrel's thick wall, extending the drilled hole longitudinally inside the wall thickness, past the blades, up to the upper section of the barrel, and out the upper section of the wall above the blades.

Alternatively, one could affix a separate conduit or tube longitudinally between the blades with inlet and outlet openings beyond the blades.

In the existing subassembly noted in U.S. patent application Ser. No. 10/521,346, which is incorporated herein by reference for all purposes, it has been discovered that the cooperation of the leaf barrel and the centralizing leaves provides an excellent opportunity to increase the space therebetween and allow drilling mud fluids to flow around, under and past the extended leaves. This increased spacing provides a bypass flow channel or passage through the leaf barrel from below the leaves to above the leaves. This has been shown to reduce the likelihood of packing-off at the extended blades. Of course, the subassembly of the above identified application may be collapsed or retracted to help eliminate any plug or pack-off at the blade/well bore wall interface.

Figure 11:
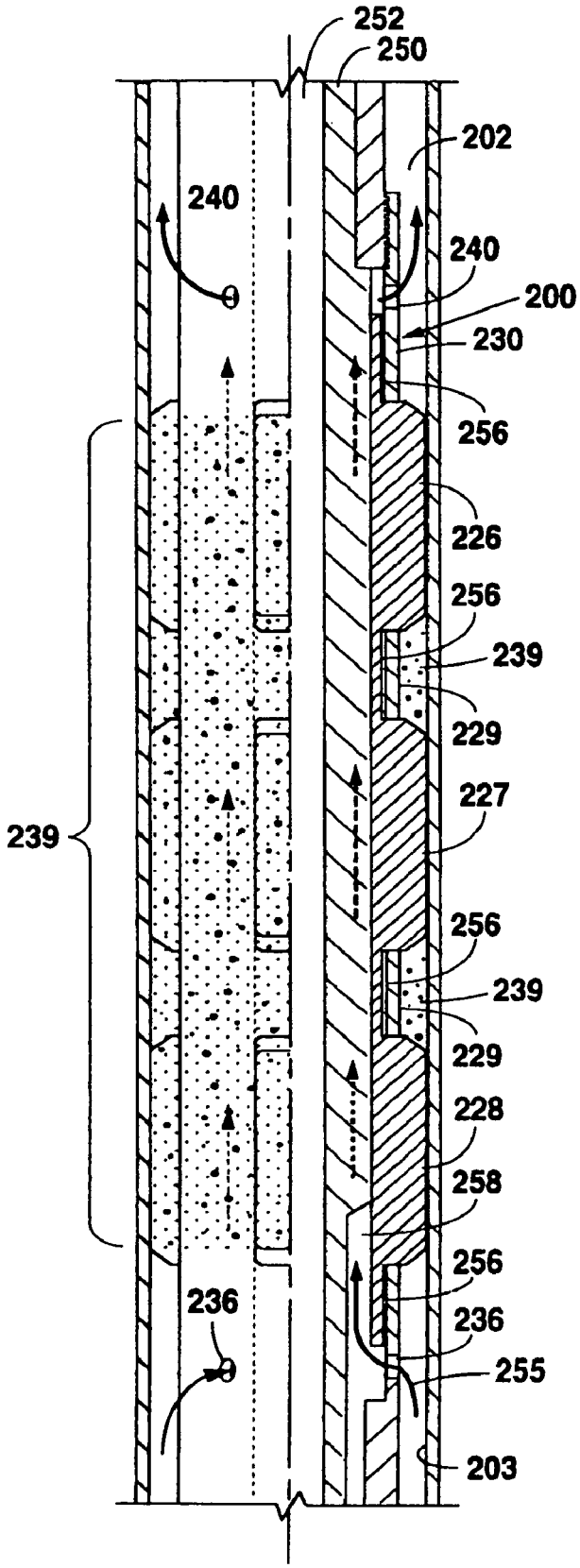
FIG. 11 is an elevation, partial cross-sectional view of a subassembly of the present invention with blades in an expanded mode with the blades contracting the well bore wall and a "pack-off" forming.

FIG. 11 illustrates a subassembly embodiment 200 (like that discussed in U.S. patent application Ser. No. 10/521,346) in a well bore 202 with blades 226, 227, and 228. Details of how the blades expand and retract are provided in the application. FIG. 11 shows the blades engaged and a "pack-off" or plug 239 formed around the blades between the well bore wall.

As will be understood from the description of other embodiments of the present invention, inlet 236 is formed in outer wall 229 of body or leaf barrel 230 along a lower section below the blades. Outlet 240 is formed in outer wall 229 along an upper section above the blades.

FIG. 11 shows how drilling mud 255 may bypass the plug 239, by entering the inlet 236, passing beneath or around the leaf blade assembly 256 through the annular space 258 between the barrel 230 and the support mandrel 250 and out outlet 240 above the blades and above the plug 239.

Although the invention has been described with reference to specific embodiments, this description is not meant to be construed in a limited sense. Various modifications of the disclosed embodiments, as well as alternative embodiments of the invention will become apparent to persons skilled in the art upon the reference to the description of the invention. It is therefore contemplated that the appended claims will cover such modifications that fall within the scope of the invention.

I claim:

1. A subassembly for a downhole drill string comprising:

a hollow body member having an outer wall and a central passage extending longitudinally from an upper end to a lower end;

a plurality of blade openings in said body member;

a plurality of blades adapted to outwardly project through said blade openings;

a fluid inlet through said outer wall in a lower section of said body below said blade openings;

a fluid outlet through said outer wall in an upper section of said body above said blade openings;

a hollow, cylindrical support mandrel extending longitudinally through said central passage in said body from below said fluid inlet to above said fluid outlet and annularly spaced apart from inner walls of said body, said support mandrel supporting said blades in said blade openings with a bottom surface of said blades in engagement with an outer surface of said support mandrel; and an annular fluid flow passage in said annular space between said support mandrel and said inner walls of said body.

2. The subassembly of claim 1 wherein said subassembly is selected from the group consisting of a stabilizer, a reamer, and a casing scraper.

3. The subassembly of claim 1 wherein said plurality of blade openings are positioned in a helical array along the length of said body between said fluid inlet and said fluid outlet.

4. The subassembly of claim 1 wherein each of said plurality of blades further comprises a channel between blade segments of said blades.

5. The subassembly of claim 1, wherein said plurality of blade openings are wedge-shaped and each of said plurality of blades are wedge-shaped to cooperate with said blade openings.

* * * * *